US010041727B2

(12) United States Patent
Yang

(10) Patent No.: US 10,041,727 B2
(45) Date of Patent: Aug. 7, 2018

(54) REFRIGERATOR HAVING LOCKING DEVICE FOR ICE BUCKET AND METHOD FOR INSTALLING LOCKING DEVICE FOR ICE BUCKET

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 255 days.

(21) Appl. No.: 14/835,505

(22) Filed: Aug. 25, 2015

(65) Prior Publication Data

US 2016/0370103 A1 Dec. 22, 2016

(30) Foreign Application Priority Data

Jun. 17, 2015 (KR) ..... 10-2015-0085835

(51) Int. Cl.

| | |
|---|---|
| ***F25D 23/00*** | (2006.01) |
| ***F25D 23/06*** | (2006.01) |
| ***F25C 5/182*** | (2018.01) |
| *F25D 25/02* | (2006.01) |

(52) U.S. Cl.

CPC ..... *F25D 23/067* (2013.01); *F25C 5/182* (2013.01); *F25D 25/025* (2013.01)

(58) Field of Classification Search

CPC .. E05B 65/0042–65/0053; F25D 23/02; F25D 23/04; F25D 23/067; F25D 23/08; F25D 25/025; F25C 5/005; F25C 5/182; F25C 5/185

See application file for complete search history.

(56) References Cited

U.S. PATENT DOCUMENTS

| | | | | |
|---|---|---|---|---|
| 3,159,368 | A * | 12/1964 | Ahlbin | B66D 3/02 224/520 |
| 5,749,241 | A | 5/1998 | Ryu et al. | |
| 2004/0183417 | A1* | 9/2004 | Ahmed | F25D 23/04 312/408 |
| 2013/0174599 | A1 | 7/2013 | Jeong et al. | |
| 2013/0263621 | A1 | 10/2013 | An et al. | |
| 2015/0061484 | A1 | 3/2015 | Jeong et al. | |

FOREIGN PATENT DOCUMENTS

| | | | |
|---|---|---|---|
| CN | 1542211 | A | 11/2004 |
| KR | 10-0168995 | B1 | 7/1997 |
| KR | 10-2013-0081137 | | 7/2013 |
| KR | 10-2013-0114848 | | 10/2013 |
| KR | 10-2015-0026694 | A | 3/2015 |

* cited by examiner

*Primary Examiner* — Jianying Atkisson
*Assistant Examiner* — Antonio R Febles

(57) ABSTRACT

There is provided a refrigerator having a locking device for an ice bucket and a method for installing a locking device for an ice bucket. A refrigerator having a locking device for an ice bucket, comprising: a main body; a storage space within the main body; an ice space configured to be disposed inside the main body, and partitioned from the storage space, and having a front opening; an ice bucket comprising an ice storage portion which stores ice generated within the ice space; and a cover member which is disposed in front of the ice storage portion to cover a front of the ice space and configured to be slidably installed in the ice space; and a locking device configured to lock the ice bucket within the ice space to prevent the ice bucket from being drawn out of the ice space by itself.

15 Claims, 8 Drawing Sheets

REFRIGERATOR HAVING LOCKING DEVICE FOR ICE BUCKET AND METHOD FOR INSTALLING LOCKING DEVICE FOR ICE BUCKET

RELATED APPLICATIONS

This application is based on and claims priority to Korean Patent Application No. 10-2015-0085835, filed on Jun. 17, 2015, the disclosure of which is incorporated herein in its entirety by reference.

FIELD OF THE INVENTION

Embodiments of the present invention generally relate to a refrigerator having an ice bucket and a method for installing a device for an ice bucket.

BACKGROUND OF THE INVENTION

A refrigerator is a device for low temperature storage of food and may be configured to provide freezing storage or cold storage according to the type of food which a user wants to store.

The inside of the refrigerator is continuously supplied by cold air. The cold air is continuously generated by a heat exchange process with a refrigerant which goes through a process of compression-condensation-expansion-evaporation. The cold air supplied to the inside of the refrigerator is evenly transferred by convection to maintain the food in the refrigerator at a desired temperature.

Generally, a main body of the refrigerator has a rectangular parallelepiped shape of which the front surface is opened and the inside of the main body may be provided with a refrigerating space and a freezing space. Further, the front surface of the main body may be provided with a refrigerating space door and a freezing space door for selective accessing of a portion of the refrigerator. A storage space in the refrigerator may be provided with multiple drawers, shelves, receiving boxes, etc., in which various food may be stored in an optimal condition.

Traditionally, a top mount type refrigerator has a freezing space positioned in an upper portion and has a refrigerating space positioned in a lower portion. Recently, however, for user convenience, a bottom freezer type refrigerator in which the freezing space is positioned in a lower portion has been released. In the case of the bottom freezer type refrigerator, a frequently used refrigerating space is positioned in an upper portion and a relatively less used freezing space is positioned in a lower position. Thus a user may conveniently use the refrigerating space. However, since the freezing space is positioned in the lower portion, the bottom freezer type refrigerator has a problem in that a user needs to bend over to open the freezing space door to remove ice.

To solve the above problem, recently, a refrigerator has been released in which an ice dispenser is installed at the refrigerating space door positioned in the upper portion of the bottom freezer type refrigerator. In this case, the refrigerating space door or the inside of the refrigerating space may be provided with an ice machine.

The ice machine may include an ice space which includes an ice tray that generates ice, an ice bucket in which the generated ice is stored, and a transfer assembly transferring the ice stored in the ice bucket to the dispenser.

The ice bucket may be drawn into the ice space or drawn out of the ice space while sliding through the opened front surface of the ice space. Further, the refrigerator may include a locking device which locks the ice bucket to prevent the ice bucket from being drawn out of the ice space by itself.

The existing locking device for the ice bucket is provided with a projection fixed at one side thereof and prevents the ice bucket from being drawn out of the ice space by itself by locking or unlocking a locking portion. The locking portion is locked to the projection, or from the projection, by a spring and an opening button.

However, the existing locking device as described above is inconvenient because operating the opening button requires both hands. Further, the existing locking device has a complicated structure due to the spring and the opening button being separately installed and thus has a high failure rate, increased cost of materials, etc.

Further, the existing locking device the ice bucket is not completely supported when the ice bucket is closed in the ice space and therefore shaking of the ice bucket may occur and an unwanted chattering sound may result.

SUMMARY OF THE INVENTION

In view of the above, embodiments of the present invention provide a refrigerator having a locking device for an ice bucket and a method for installing a locking device for an ice bucket capable of preventing ice bucket movement in the front, back, left, and right side directions by elastically supporting the ice bucket between an elastic coupling portion and a projection when the ice bucket is closed in an ice room.

In accordance with an embodiment of the present invention, there is provided a refrigerator having a locking device for an ice bucket, the refrigerator including: a main body; a storage space formed inside the main body; an ice space inside the main body and partitioned from the storage space and having a front opening. The refrigerator further includes an ice bucket including an ice storage portion which stores ice generated in the ice space and a cover member which is disposed in front of the ice storage portion to cover the front of the ice space and slidably installed in the ice space to open and close the ice space. The refrigerator further includes a locking device configured to lock the ice bucket to the ice space to prevent the ice bucket from being drawn out of the ice space by itself. The locking device includes: a projection configured to protrude from an inner wall of the ice space toward the ice bucket and having a cylindrical shape or a polyprismatic shape; and an elastic coupling portion disposed at least one of an upper portion or a lower portion of the ice bucket and formed with a size corresponding to a width of the projection and configured to be elastically inserted into the projection.

The projection may be separably coupled with a fixing body which is fixed to the inner wall of the ice room.

The projection may include: a cylindrical portion configured for insertion into the elastic coupling portion; and a flange portion formed at an end of the cylindrical portion and having a diameter larger than that of the cylindrical portion to prevent the cylindrical portion from being separated from the elastic coupling portion in a vertical direction.

The elastic coupling portion may include a circular rim portion formed with a size corresponding to the width of the projection and configured to adhere to an outer peripheral surface of the projection. The circular rim portion may have a structure wherein a first portion contacting the projection is open and another portion encloses the projection. The elastic coupling portion may include a plurality of rib portions extending from the rim portion toward the ice bucket and are disposed to be spaced apart from each other at a predetermined interval along a circumferential direction of the rim portion.

Both sides of the open portion of the rim portion may include guide portions which extend toward the outer sides of elastic coupling portion so that the rim portion is configured to be easily inserted into the projection.

The locking device may be installed at either of the upper portion and the lower portion of the ice bucket and the other portion of the ice bucket may be disposed with a first locking hook extending from the ice space and a second locking hook, extending from the ice bucket, to be locked to the first locking hook.

The locking device may be installed at both the upper portion and the lower portion of the ice bucket.

In accordance with another embodiment of the present invention, there is provided a method for installing a locking device for an ice bucket, the method including: molding a projection formed in at least one of a cylindrical shape and a polyprismatic shape with a predetermined diameter; installing the projection to protrude from an inner wall of an ice room of the refrigerator towards the ice bucket; and forming an elastic coupling portion, wherein the elastic coupling portion is elastically inserted into the projection, and disposed in at least one of an upper portion and a lower portion of the ice bucket.

The projection may be molded to include a cylindrical portion configured to be inserted into the elastic coupling portion and a flange portion formed at an end of the cylindrical portion and having a diameter larger than that of the cylindrical portion.

The elastic coupling portion may be molded to include a circular rim portion formed with a size corresponding to the width of the projection and configured to adhere to an outer peripheral surface of the projection. The circular rim portion may have a structure in which a first portion contacting the projection is open and another portion encloses the projection. The elastic coupling portion may further include a plurality of rib portions extending from the rim portion toward the ice bucket and spaced apart from each other at a predetermined interval along a circumferential direction of the rim portion.

Both sides of the open portion of the rim portion may include guide portions which extend toward the outer sides of the elastic coupling portion so that the projection is easily inserted into the rim portion.

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Figure 1:
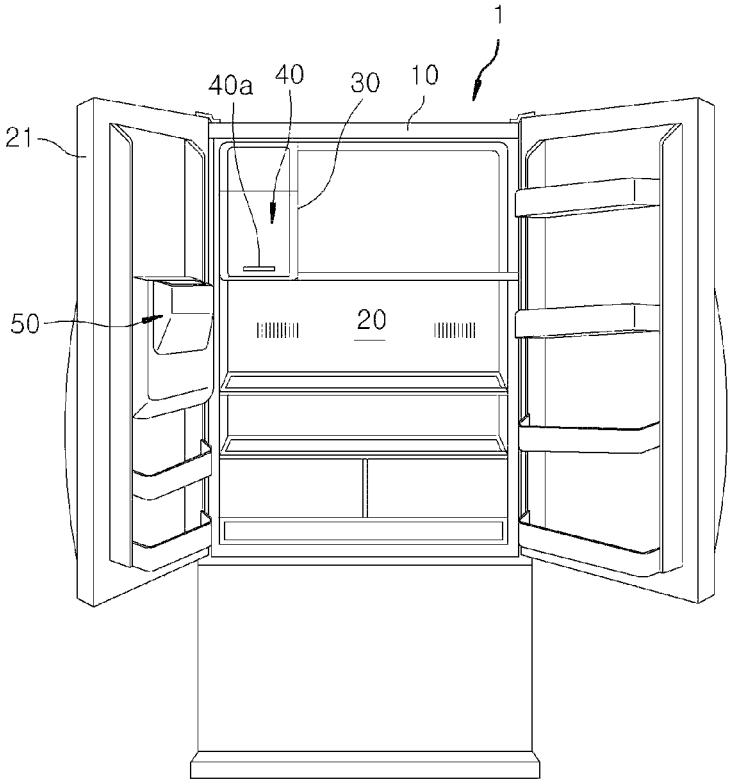
FIG. 1 is a front view of an exemplary refrigerator according to an embodiment of the present invention.

Hereinafter, constructions and actions according to embodiments of the present invention will be described in detail with reference to the accompanying drawings. The following description is one of aspects of the present invention which may be claimed as a patent and may form a portion of the detailed technologies of the present invention.

However, in describing the embodiments of the present invention, a detailed description of well-known constructions or functions will be omitted to make the present invention clear.

The present invention may be variously changed and include various embodiments, so that specific embodiments are illustrated in the drawings and will be described in detail below. However, it is to be understood that the present invention is not limited to the specific embodiments, but includes all modifications, equivalents, and substitutions included in the spirit and the scope of the present invention.

Terms including an ordinal number such as 'first', 'second', etc., can be used to describe various components, but the components are not to be construed as being limited to the terms. The terms are only used to distinguish one component from another component.

Terms used in the present application are used only in order to describe specific embodiments rather than limiting the present invention. Singular forms are intended to include plural forms unless the context clearly indicates otherwise. It will be further understood that the terms "comprises" or "have" used in this application, specify the presence of stated features, numerals, steps, operations, components, parts, or a combination thereof, but do not preclude the presence or addition of one or more other features, numerals, steps, operations, components, parts, or a combination thereof.

Hereinafter, one embodiment of the present invention will be described with reference to the accompanying drawings.

Figure 2:
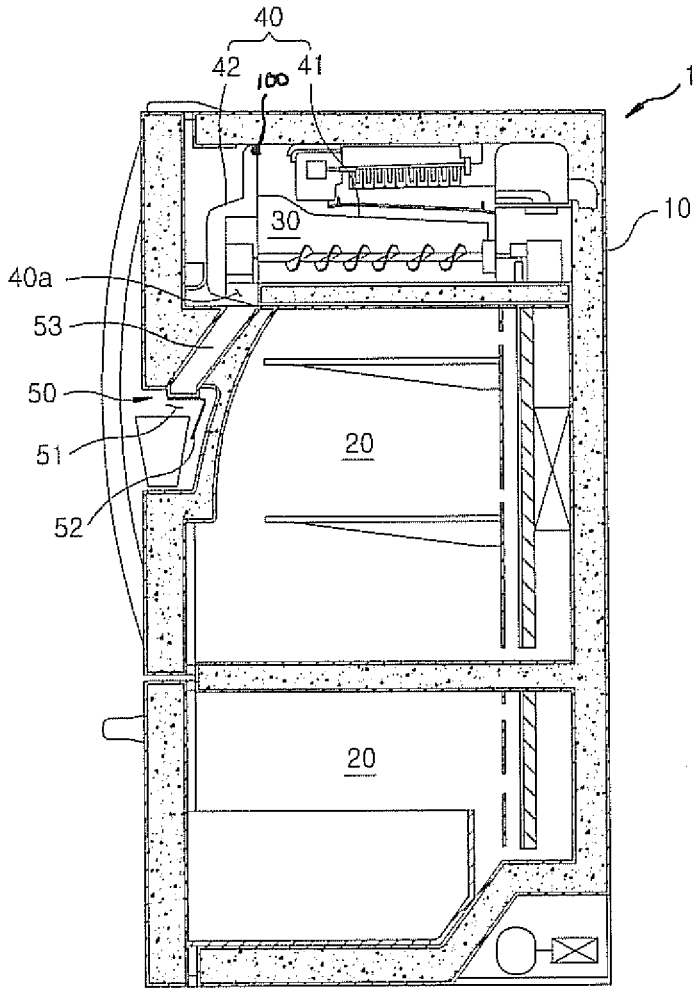
FIG. 2 is a side cross-sectional view of the refrigerator of FIG. 1.

FIG. 1 is a front view of an exemplary refrigerator according to an embodiment of the present invention and FIG. 2 is a side cross-sectional view of the refrigerator of FIG. 1.

Referring to FIGS. 1 and 2, a refrigerator 1 having a locking device 100 for an ice bucket 40 according to an embodiment of the present invention may include a main body 10, a storage space 20, an ice space 30, the ice bucket 40, and the locking device 100.

The description that an embodiment of the present invention includes the components listed above does not mean that the present invention does not include only the above components but means that the present invention can include these components and that the present invention may include other components (for example, technologies widely known with respect to refrigerators). However, the detailed description of known technologies will be omitted if it is deemed that such description would make the description of the present invention unnecessarily vague.

The main body 10 forms the appearance and supporting structure of the refrigerator 1 and may provide a space in which the components listed above and other components used in the operation of the refrigerator 1 may be formed or installed therein.

The storage space 20 is formed inside the main body 10 and has a front surface opening. The storage space 20 may be partitioned into a refrigerating space and a freezing space by a partition wall.

The front surface of the storage space 20 may be opened and closed by a pair of doors 21 which rotate and are hinge-coupled with the main body 10. The door 21 may be provided with a dispenser 50 which may extract ice generated in the ice space 30 from the outside without opening the door 21.

The dispenser 50 may include an extraction space 51 which may allow ice to be dispensed, a lever 52 which may select whether to extract ice, and a chute 53 which guides ice discharged through an ice discharge port 40*a* of the ice bucket 40 to the extraction space 51.

Further, the ice space 30 may be disposed inside the main body 10 and partitioned from the storage space 20. The ice space 30 may be formed to have a front opening. The ice space 30 may be disposed at one side of the storage space 20 and may be partitioned from the storage space 20 by a wall of the ice space.

The ice space 30 may be provided with an ice assembly to generate ice, the ice assembly may be of any well-known design and therefore a detailed description thereof will be omitted.

Further, the ice bucket 40 may be slidably installed in the ice space 30 to open and close the ice space 30. The ice bucket 40 may include an ice storage portion 41 which stores ice generated in the ice space 30 and a cover member 42 which is disposed in front of the ice storage portion 41 to cover the front of the ice space 30.

Further, the locking device 100 may lock the ice bucket 40 to the ice space 30 to prevent the ice bucket 40 from being drawn out of the ice space 30 by itself. When the ice bucket 40 is locked to the ice space 30 by the locking device 100, the ice bucket 40 may not be drawn out from the ice space 30 by itself as long as a user does not apply an external force and may be kept in a locking state.

Hereinafter, the locking device 100 will be described in detail with reference to FIGS. 3 to 7.

Figure 3:
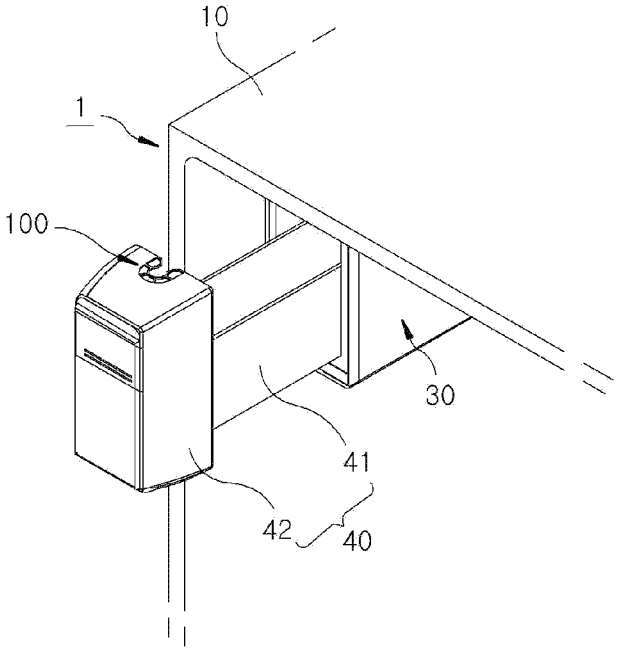
FIG. 3 is a perspective view illustrating an ice bucket that is drawn out from an ice space of the refrigerator illustrated in FIG. 1.
Figure 4:
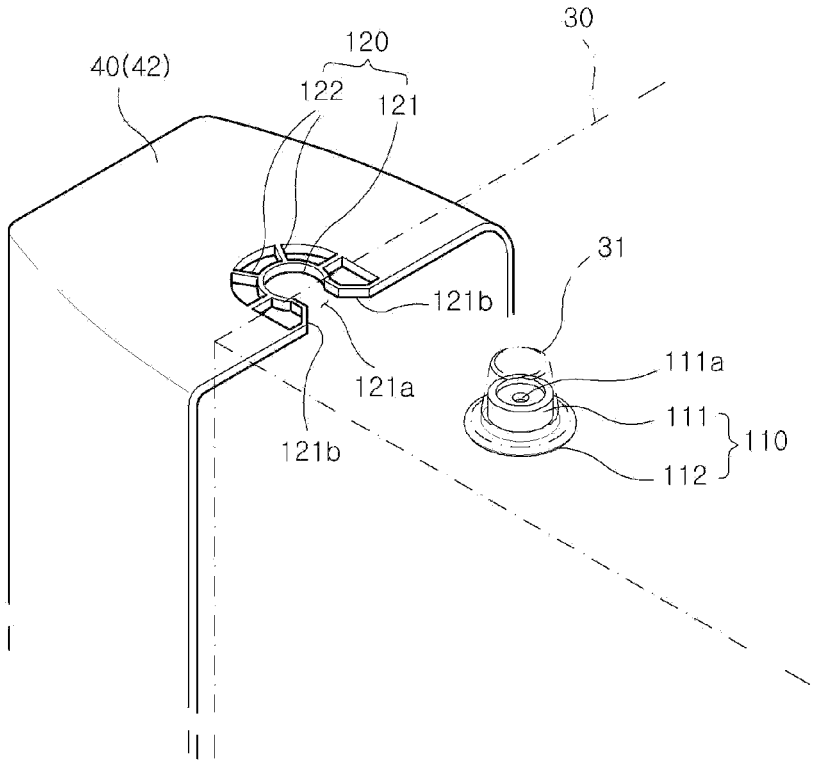
FIG. 4 is a view illustrating an exemplary locking device for an ice bucket according to an embodiment of the present invention.
Figure 5:
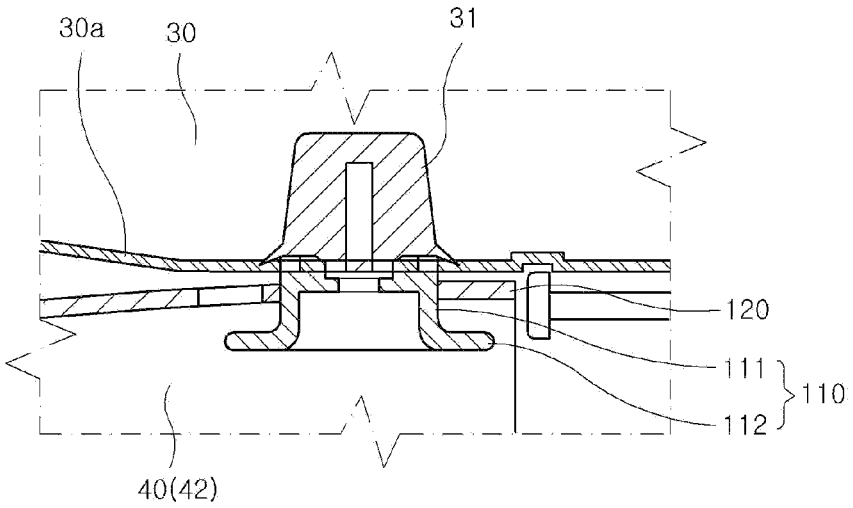
FIG. 5 is a side cross-sectional view illustrating a locking state of the locking device for the ice bucket according to an embodiment of the present invention.
Figure 6:
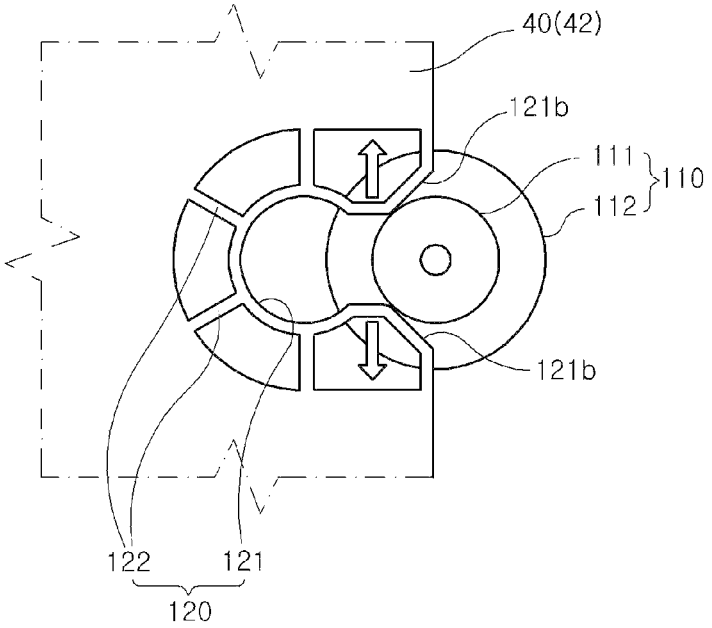
FIGS. 6 and 7 are views illustrating an exemplary operation of the locking device of the ice bucket, according to an embodiment of the present invention.
Figure 7:
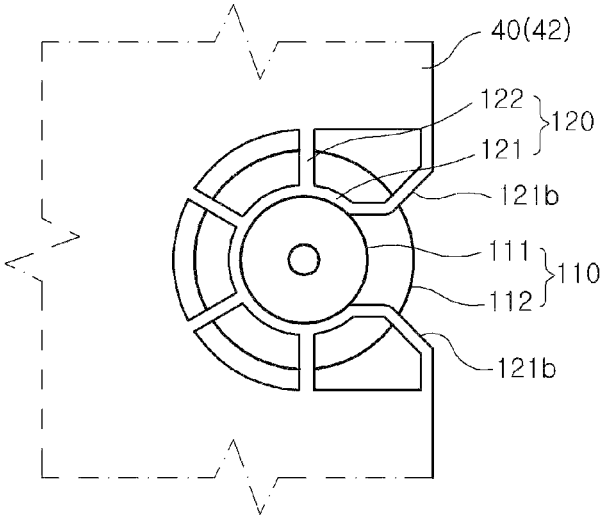

FIG. 3 is a perspective view illustrating an ice bucket that is drawn out from an ice space of the refrigerator illustrated in FIG. 1, FIG. 4 is a view illustrating a locking device for an ice bucket according to an embodiment of the present invention, FIG. 5 is a side cross-sectional view illustrating a locking state of the locking device for the ice bucket according to the embodiment of the present invention, and FIGS. 6 and 7 are views illustrating an operation of the locking device according to an embodiment of the present invention.

Referring to FIGS. 3 to 5, the locking device 100 may include a projection 110 installed at an inner wall of the ice space 30 and an elastic coupling portion 120 formed in the ice bucket 40.

As illustrated in FIGS. 4 and 5, the projection 110 may protrude from the inner wall of the ice space 30 toward the ice bucket 40 and may be formed in a cylindrical shape or a polyprismatic shape. The projection 110 may be directly installed at the inner wall of the ice room 30 but may be separably coupled with a fixed body 31, which is installed at and fixed to the inner wall of the ice room 30 (e.g., by a screw or a bolt).

In one embodiment, when the projection 110 is installed on the ceiling 30*a* of the ice space 30, the projection 110 may be disposed to protrude downward from a position contacting the cover element 42 of the ice bucket 40. Further, when the projection 110 is installed on the floor of the ice space 30, the projection 110 may be disposed to protrude upward from a position contacting the cover element 42 of the ice bucket 40 or the ice storage portion 41.

The projection 110 may include a cylindrical portion 111 and a flange portion 112.

The cylindrical portion 111 is a portion configured to be inserted into the elastic coupling portion 120 and may be formed in a cylindrical shape or a polyprismatic shape (e.g., a polygon, a pentagon, etc.). The cylindrical portion 111 may have a predetermined diameter and may include a coupling hole 111*a* to be coupled with the inner wall of the ice room 30 or the coupling body 31.

The flange portion 112 is formed at an end of the cylindrical portion 111. The flange portion 112 is formed with a larger diameter than that of the cylindrical portion 111, such that the cylindrical portion 111 is prevented from being vertically separated after being inserted into the elastic coupling portion 120.

Moreover, as illustrated in FIG. 4, the elastic coupling portion 120 may be disposed in at least one of the upper portion and the lower portion of the ice bucket 40. The elastic coupling portion 120 may be formed with a size corresponding to a width of the projection 110 (e.g., cylindrical portion 111) to be removably and elastically coupled with the projection (e.g., cylindrical portion 111).

The elastic coupling portion 120 holds an elastic force by a structure to be elastically inserted into the projection 110. After the elastic coupling portion is inserted into the projection 110, the elastic coupling portion is preferably designed to restrict movement in each of the directions of the front, back, left, and right sides. To achieve the above objects, the elastic coupling portion 120 may include a rim portion 121 and a rib portion 122.

The rim portion 121 may be formed having a size corresponding to the width of the projection 110 and configured to adhere to an outer peripheral surface of the projection 110. When the rim portion 121 and the projection 110 are coupled together, the rim portion 121 may have a circular structure in which one portion 121*a* is opened so that the rim portion 121 has a structure in which the portion 121*a* first contacting the projection 110 in the rim portion 121 is open and the remaining portion thereof encloses the projection 110.

Further, the rib portion 122 extends from the rim portion 121 toward the ice bucket 40 over a predetermined length and may be formed as a plurality of ribs spaced apart from each other at a predetermined spacing interval along a circumferential direction of the rim portion 121.

Both sides of the open portion 121*a* in the rim portion 121 may include guide portions 121*b* which extend from the rim portion 121 toward the outer sides the elastic coupling portion so that the projection (e.g., cylindrical portion 111) can be easily inserted into the rim portion 121.

Therefore, when the ice bucket 40 is moved to close the ice room 30, the elastic coupling portion 120 formed in the ice bucket 40 moves along the direction of movement of the ice bucket 40. During the movement of the elastic coupling portion 120, the rim portion 121 contacts the projection 110 as illustrated in FIG. 6. Both sides of the open portion 121*a* of the rim portion 121 first contact the guide portions 121*b*, and therefore the projection 110 may be guided and easily inserted into the rim portion 121.

When the projection 110 is inserted into the rim portion 121, the open portion 121*a* of the rim portion 121 and the rib portion 122 are temporarily distorted elastically, and then as illustrated in FIG. 7, recover to an original position when the projection 110 is completely positioned in the rim portion 121.

When the positions of rim portion 121 and the rib portion 122 are restored by the elastic force, the rim portion 121 and the rib portion 122 adhere to the outer peripheral surface of the projection 110 to elastically couple with the projection 110. As such, the ice bucket 40 is coupled with the elastic coupling portion 120 and is elastically restrained from moving in each of the directions of the front, back, left, and right sides.

Figure 8:
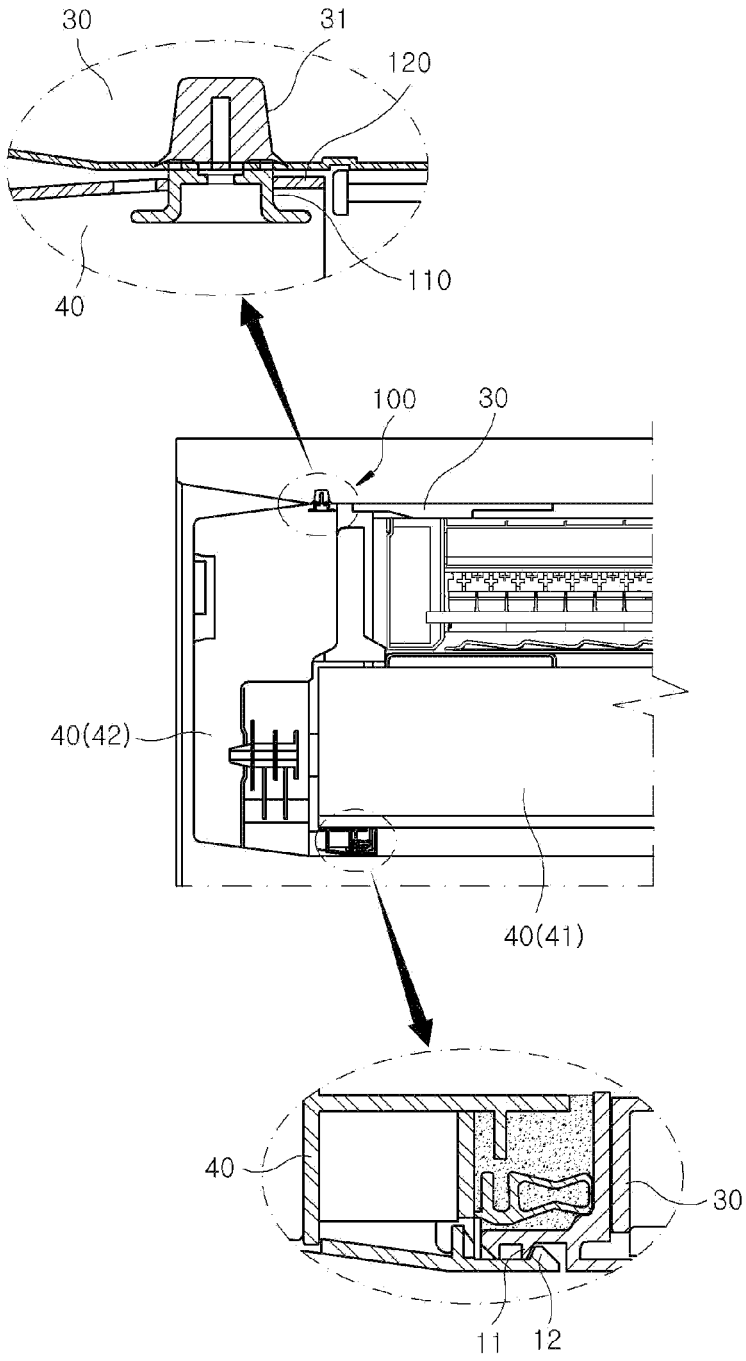
FIG. 8 is a diagram illustrating the locking device for the ice bucket, according to the embodiment of the present invention, installed at one of an upper portion and a lower portion of the ice bucket.

As illustrated in FIG. 8, the locking device 100 is installed at one of the upper portion and the lower portion of the ice bucket 40. One of the upper portion and the lower portion of the ice bucket 40 may include a first locking hook 11 extending from the ice space 30. A second locking hook 12 may extend from the ice bucket 40 to be locked to the first locking hook 11.

FIG. 8 illustrates that the upper portion of the ice bucket 40 is disposed with the locking device 100 and the lower portion of the ice bucket 40, at which the locking device 100 is not installed, may be disposed with the first locking hook 11 and the second locking hook 12 to lock the ice space 30 and the ice bucket 40. In another embodiment, the lower portion of the ice bucket 40 is disposed with the locking device 100 and the upper portion of the ice bucket 40 may be disposed with the first locking hook 11 and the second locking hook 12 to lock the ice space 30 and the ice bucket 40.

Figure 9:
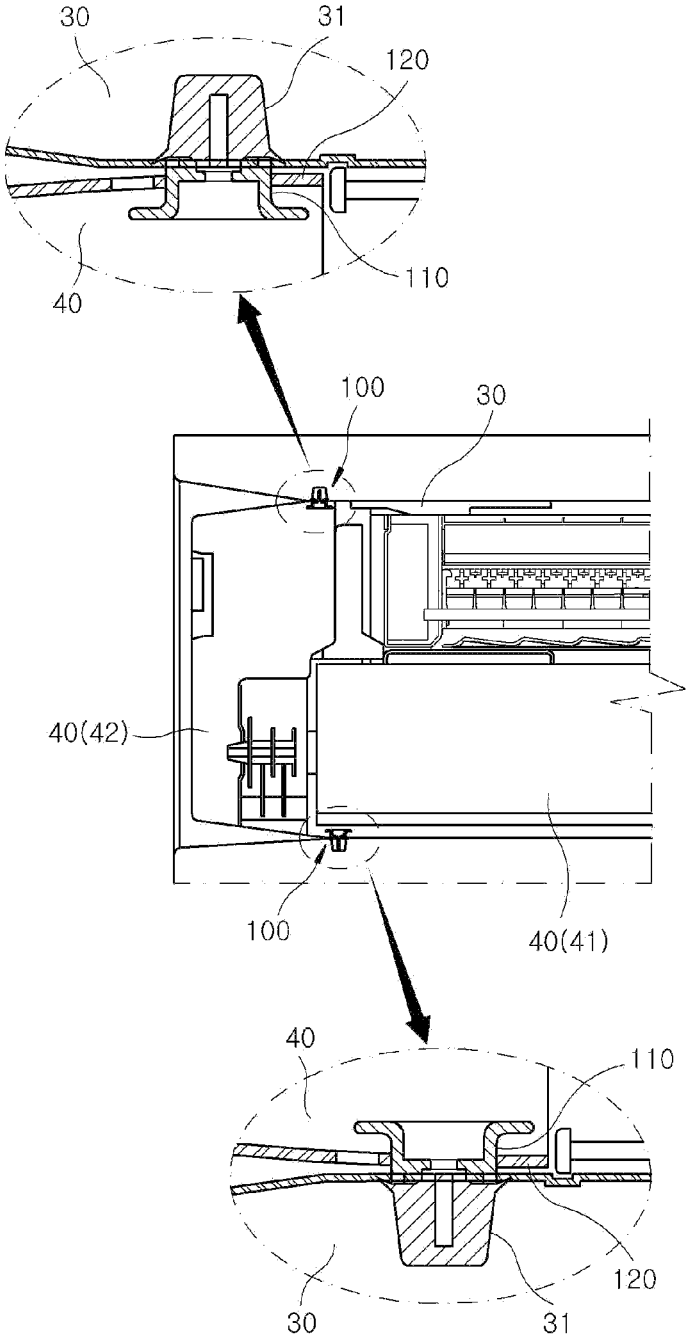
FIG. 9 is a diagram illustrating a locking device of the ice bucket, according to an embodiment of the present invention, installed at both the upper portion and the lower portion of the ice bucket.

Moreover, as illustrated in FIG. 9, the locking device 100 may also be installed both at the upper portion and the lower portion of the ice bucket 40.

Hereinafter, an exemplary method for installing a locking device for an ice bucket according to another embodiment of the present invention will be described and a detailed description thereof will cite the foregoing description.

To install the locking device 100 for the ice bucket 40, the projection 110 is molded and formed in a cylindrical shape or a polyprismatic shape with a predetermined diameter. The projection 110 may be molded to include the cylindrical portion 111 configured to be inserted into an elastic coupling portion 120 and a flange portion 112 formed at the end of the cylindrical portion 111 with a diameter larger than that of the cylindrical portion 111.

After the projection 110 is molded, the projection 110 may be installed at the inner wall of the ice space 30 of the refrigerator. In this case, the projection 110 may be installed to protrude toward the ice bucket 40.

At least one of the upper portion and the lower portion of the ice bucket 40 may include the circular elastic coupling portion 120 which is configured to be elastically coupled with the projection 110.

The elastic coupling portion 120 may be molded to include a circular rim portion 121 which is formed with a size corresponding to the width of the projection 110 and configured to adhere to the projection 110. The circular rim portion 121 may include a structure in which a first portion configured for contacting the projection 110 is open and a remaining portion encloses the projection 110. The circular rim portion 121 may further include a plurality of rib portions 122 which extend from the rim portion 121 toward the ice bucket and are disposed to be spaced apart from each other at a predetermined spacing interval along a circumferential direction of the rim portion 121.

Both sides of the open portion of the rim portion 121 may include guide portions 121*b* which extend from the open portion towards the outer sides of the elastic coupling portion 121 so that the projection 110 is easily inserted.

By a series of processes as described above, the installation of the locking device 100 is completed.

According to the embodiment of the present invention, the user may advantageously draw out the ice bucket with one hand to increase the convenience of the ice bucket and the structure may be simplified to save material cost and improve durability.

Further, advantageously the ice bucket does not move in any of the directions of the front, back, left, and right sides due to elastic coupling of the ice bucket via the elastic coupling portion and the projection when the ice bucket is closed in an ice space. Therefore no chattering of the ice bucket occurs and the ice bucket may be stably supported.

While the embodiments of the present invention have been described with respect to the preferred embodiments, the scope of the present invention is not limited to the specific embodiments. It will be understood that a person having ordinary skill in the art to which the present invention pertains may substitute and change components without any limitation and these substitutions and changes also belong to the scope of the present invention.

What is claimed is:

1. A refrigerator, comprising:

a main body having a storage space therein;

an ice space disposed inside the main body, and partitioned from the storage space, and having a front opening;

an ice bucket comprising: an ice storage portion for storing ice generated within the ice space; and a cover member which is disposed in front of the ice storage portion to cover a front of the ice space and configured to be slidably installed in the ice space; and a first locking device configured to lock the ice bucket within the ice space to prevent the ice bucket from being singularly drawn out of the ice space, wherein the first locking device comprises:

a projection configured to protrude from an inner wall of the ice space toward the ice bucket and having at least one of a cylindrical shape and a polyprismatic shape; and an elastic coupling portion disposed in at least one of an upper portion and a lower portion of the ice bucket and having a size corresponding to a width of the projection and configured to be elastically inserted into the projection, wherein the elastic coupling portion comprises:

a circular rim portion having a size corresponding to the width of the projection and configured to adhere to an outer peripheral surface of the projection and having a structure in which a first portion is configured for contacting the projection and is open and a second portion that encloses the projection; and a plurality of rib portions extending from the rim portion toward the ice bucket and spaced apart from each other at a predetermined spacing interval along a circumferential direction of the rim portion.

2. The refrigerator of claim 1, wherein the projection is separably coupled with a fixing body which is coupled to the inner wall of the ice room.

3. The refrigerator of claim 1, wherein the projection comprises:

a cylindrical portion configured to be inserted into the elastic coupling portion; and a flange portion formed at an end of the cylindrical portion and having a diameter larger than that of the cylindrical portion and configured to prevent the cylindrical portion from being vertically separated from the elastic fixing portion.

4. The refrigerator of claim 1, wherein both sides of the open portion of the rim portion comprise guide portions which extend towards an outer side of the elastic coupling portion so that the rim portion can be inserted into the projection.

5. The refrigerator of claim 1, wherein the first locking device is disposed at one of the upper portion and the lower portion of the ice bucket, and wherein an opposing side of the ice bucket comprises a first locking hook extending from the ice space and comprising:

a second locking hook extending from the ice bucket lock to the first locking hook.

6. The refrigerator of claim 1, further comprising a second locking device, wherein one of the first locking device and the second locking device is disposed in the upper portion of the ice bucket and another one of the first locking device and the second locking device is disposed at the lower portion of the ice bucket.

7. A method for installing a locking device for an ice bucket, the method comprising:

molding a projection formed in at least one of a cylindrical shape and a polyprismatic shape with a predetermined diameter;

installing the projection to protrude from an inner wall of an ice space of the refrigerator towards the ice bucket; and forming an elastic coupling portion, configured for elastically coupling with the projection, wherein the elastic coupling portion is formed in one of an upper portion and a lower portion of the ice bucket, wherein the elastic coupling portion comprises a circular rim portion formed having a size corresponding to the width of the projection and configured to adhere to an outer peripheral surface of the projection and having a structure in which a first portion is configured to contact the projection and is open and a second portion that encloses the projection, and wherein the elastic coupling portion further comprises a plurality of rib portions extending from the rim portion towards the ice bucket and disposed to be spaced apart from each other at a predetermined spacing interval along a circumferential direction of the rim portion.

8. The method of claim 7, wherein the projection comprises: a cylindrical portion configured to be inserted into the elastic coupling portion; and a flange portion formed at an end of the cylindrical portion and having a diameter larger than that of the cylindrical portion.

9. The method of claim 7, wherein both sides of the first portion of the rim portion comprise guide portions extending towards an outer side of the elastic coupling portion wherein the projection can be inserted into the rim portion.

10. An apparatus, comprising:

an ice bucket comprising: an ice storage portion for storing ice generated within an ice space; and a cover member which is disposed in front of the ice storage portion to cover a front of the ice space and configured to be slidably installed in the ice space; and a first locking device configured to lock the ice bucket within the ice space, wherein the first locking device comprises:

a projection protruding from an inner wall of the ice space toward the ice bucket; and an elastic coupling portion having a size corresponding to a width of the projection and configured to be elastically inserted into the projection, wherein the elastic coupling portion comprises:

a circular rim portion having a size corresponding to the width of the projection and configured to adhere to an outer peripheral surface of the projection and having a structure in which a first portion configured for contacting the projection is open and a second portion encloses the projection; and a plurality of rib portions extending from the rim portion toward the ice bucket and spaced apart from each other at a predetermined spacing interval along a circumferential direction of the rim portion.

11. The apparatus of claim 10, wherein the projection is separably coupled with a fixing body which is coupled to the inner wall of the ice room.

12. The apparatus of claim 10, wherein the projection comprises:

a cylindrical portion configured to be inserted into the elastic coupling portion; and a flange portion formed at an end of the cylindrical portion and having a diameter larger than that of the cylindrical portion, and configured to prevent the cylindrical portion from being vertically separated from the elastic fixing portion.

13. The apparatus of claim 10, wherein both sides of the open portion of the rim portion comprise guide portions which extend towards an outer side of the elastic coupling portion allowing the rim portion to be inserted into the projection.

14. The apparatus of claim 10, wherein the first locking device is disposed at one of an upper portion and a lower portion of the ice bucket, and wherein an opposing side of the ice bucket comprises a first locking hook extending from the ice space and comprising:

a second locking hook extending from the ice bucket lock to the first locking hook.

15. The apparatus of claim 10, further comprising a second locking device, wherein one of the first locking device and the second locking device is disposed in an upper portion of the ice bucket and another one of the first locking device and the second locking device is disposed at a lower portion of the ice bucket.

* * * * *